United States Patent [19]

Zuss

[11] Patent Number: 4,466,563

[45] Date of Patent: Aug. 21, 1984

[54] TOILET PAPER CONTROLLED DISPENSER

[76] Inventor: Sidney M. Zuss, Room 3615 Woolworth Bldg., 233 Broadway, New York City, N.Y. 10007

[21] Appl. No.: 344,883

[22] Filed: Feb. 1, 1982

[51] Int. Cl.[3] ..... A47K 10/36

[52] U.S. Cl. ..... 225/74; 225/91

[58] Field of Search ..... 225/72–75, 225/91

[56] References Cited

U.S. PATENT DOCUMENTS

| | | | |
|---|---|---|---|
| 1,008,192 | 11/1911 | Olin | 225/74 X |
| 1,243,569 | 10/1917 | Taylor | 225/73 X |
| 2,138,338 | 11/1938 | Casasco | 225/74 |
| 2,400,776 | 5/1946 | Nordeen et al. | 225/74 |
| 3,104,043 | 9/1963 | Wyant | 225/74 X |
| 3,176,892 | 4/1965 | Waltz | 225/76 X |
| 3,190,520 | 6/1965 | Wyant | 225/73 X |

FOREIGN PATENT DOCUMENTS

| | | | |
|---|---|---|---|
| 437446 | 7/1948 | Italy | 225/74 |

*Primary Examiner*—Frank T. Yost

[57] ABSTRACT

A toilet paper dispenser, including a U-shaped base rigidly affixed to a wall below a toilet paper holder, the base supporting a pivotable, generally flat member having a serrated lower cutting edge around which toilet paper is pulled for being torn off.

3 Claims, 5 Drawing Figures

TOILET PAPER CONTROLLED DISPENSER

This invention relates generally to toilet paper holders such as are mounted on a bathroom wall, and on which a roll of toilet paper is installed so that some toilet tissue may be torn off for use.

It is well known that sometimes it can be difficult to locate an end of the toilet tissue when it has been previously torn off at the surface of the roll, so that a person hunting for the paper, end, is obliged to rotate it forwardly or backwardly so to find it.

This situation is objectionable and is therefore in need of an improvement.

Therefore it is a principal object of the present invention, to provide a toilet paper controlled dispenser which overcomes the above described situation, by permitting the paper to be torn off only from an already unrolled portion of the roll, so that the lasting end of the paper is instantly located for being pulled.

Figure 1:
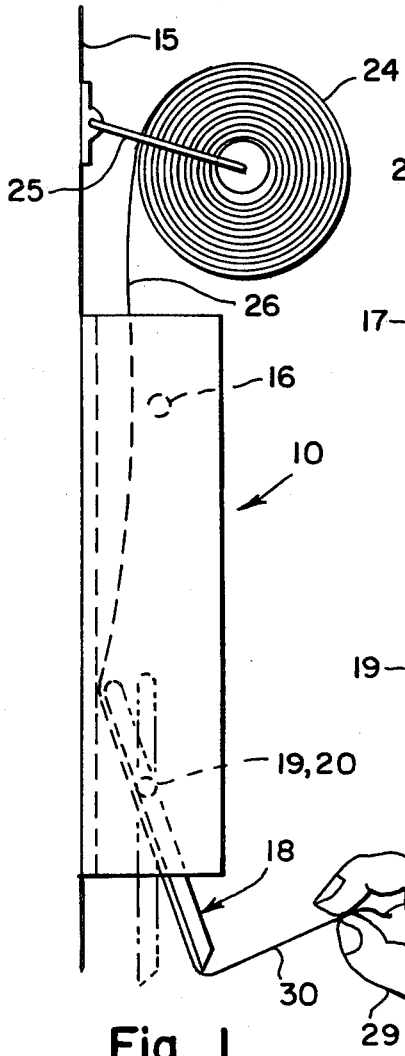
FIG. 1 is an end elevation view of the invention shown installed on a wall, and toilet tissue being fed therethrough.
Figure 2:
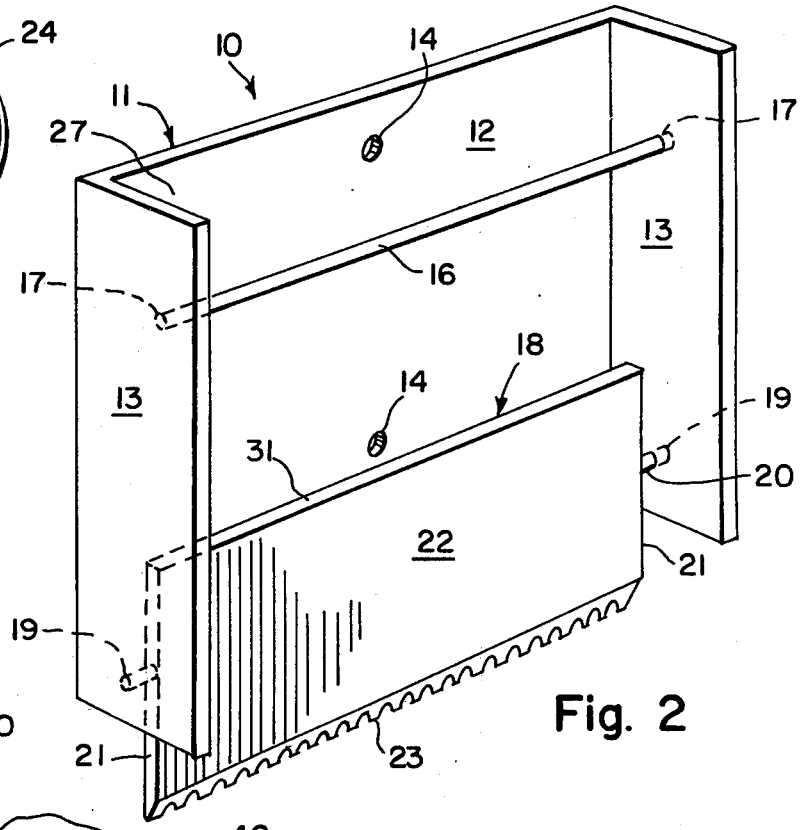
FIG. 2 is a perspective view of the invention shown alone.

Referring now to the drawing in greater detail, and more particularly to FIGS. 1 and 2 thereof, at this time, the reference numeral 10 represents a one model of a Toilet Paper Controlled Dispenser according to the present invention, wherein there is a generally U-shaped base 11 comprising a flat intermediate panel 12 and a flat side panel 13 at right angle thereto at each opposite side end thereof. The intermediate panel includes a pair of mounting holes 14 therethrough in order to receive nails or screws for rigid securement of the base to a wall 15 of a bathroom or lavatory. The base is preferably molded from a hard plastic material in order to be inexpensive to make, and be smooth surfaced so to be easily kept clean and sanitary, while being easily manufactured in any color so as to harmonize with any room decor. Alternately it may be made of wood or metal, as preferred by a manufacturer.

A steel rod 16 is supported between an upper hole 17 in each side panel 13.

A wing or blade 18 is supported freely pivotable between a lower hole 19 on each side panel, the axially aligned holes 19 each receiving a stub shaft 20 formed on opposite side edges 21 of the wing. The wing comprises a flat panel 22 which has a serrated cutting lower edge 23 on its freely downward depending end. The wing may likewise be molded of a hard plastic material or be made of wood or steel, as preferred.

In operative use, a toilet paper roll 24 is supported from a bracket 25 mounted on the wall 15 and located above the dispenser 10, so that the toilet tissue paper 26 from the roll is unrolled downward into the channel 27 formed between the side panels 13, the paper 26 being passed behind the steel rod 16 and behind the wing, as shown in FIG. 1, so that a leading edge 28 of the unrolled portion of the paper 26 can be grasped by a persons hand 29 and pulled downward so to form a paper tail 30 as long as wished, for being torn off and used by the person, the tail being torn off by lifting the leading edge forwardly as shown in FIG. 1, and then tearing the paper across the serrated cutting edge 23.

It is to be noted tht when the leading edge is pulled in order to tear off the paper tail, the wing then pivots so that an upper edge of the wing holds the paper 26 against the front side of the intermediate panel 12 and prevents more paper to unwind from the roll while the person pulls the edge 28 during the tearing operation. After the tail is disconnected from the rest of the paper 26, the new leading edge for the next tail is now directly behind the cutting edge, so that the next person needs only to reach around an underside of the wing and therebehind so to pull the paper downward and repeat the above described operation.

Figure 3:
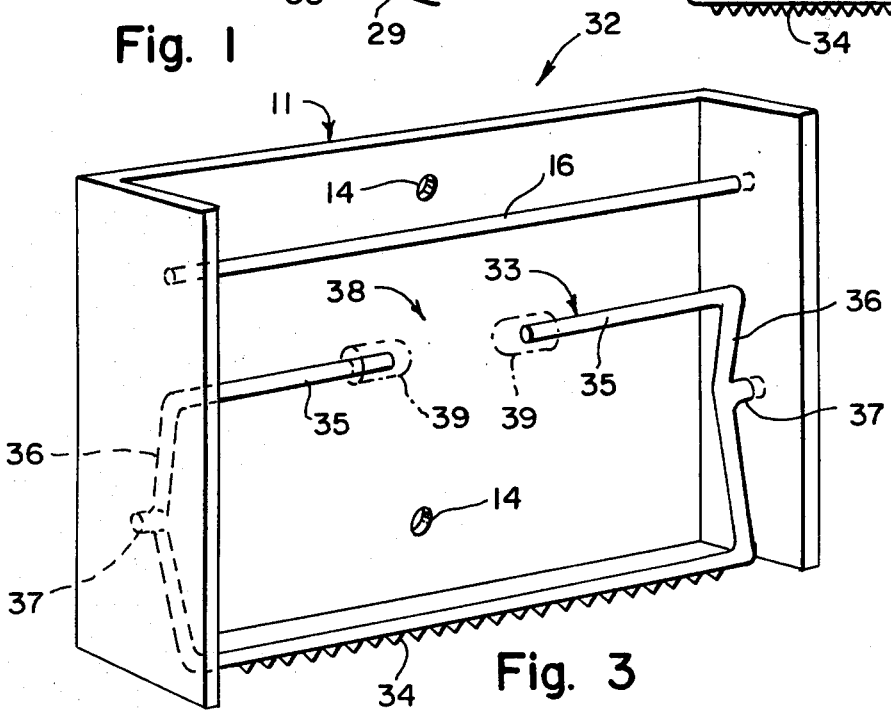
FIG. 3 is a perspective view of another design of the invention.
Figure 4:
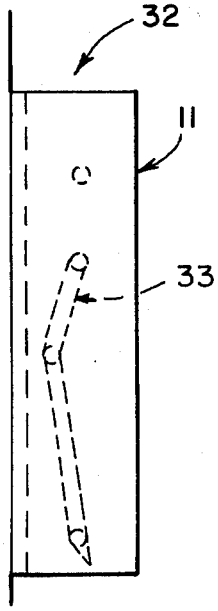
FIG. 4 is an end elevation view of the device shown in FIG. 3.

In a modified design 32 of the invention, shown in FIGS. 3 and 4, the same above described base 11 and steel rod 16 are used.

However, the wing 18 is replaced by a stiff wire frame 33 that is bent into an open loop as shown, and includes serrated lower side 34, axially aligned, gap-spaced upper side ends 35 and V-angled side ends 36 onto each of which a stub shafts 37 is welded. The wire frame operates a same as the wing 18.

In yet another design of wire frame 38, a soft rubber socket cap 39 is fitted on each end 35 of the wire so as to be smoother to the touch and also to provide a more finished appearance, as shown by the phantom lines in FIG. 3.

Figure 5:
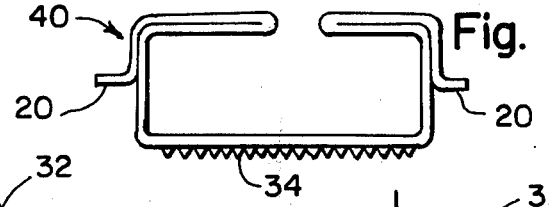
FIG. 5 is a side elevation view of another design of wire frame which comprises a component of the invention.

In still another design 40 of the wire frame shown in FIG. 5, each above described end thereof is folded over and extends around the outer side of the frame so to form the above described stub shafts, which thus eliminate the welding operation by being made all in one piece.

While various changes may be made in the detail construction, it is understood that such changes will be within the spirit and scope of the present invention as is defined by the appended claims.

What is claimed:

1. A toilet paper controlled dispenser, comprising in combination a U-shaped base having a web and spaced flanges for being rigidly affixed vertically to a wall, and a member pivotally supported within said base, said member including a serrated lower cutting edge around which toilet paper, pulled from a roll, is torn off, after being passed downward behind a rear of said pivotable member, said member having an upper edge for holding said pulled paper against said base when said member is pivoted by pulling said paper against said serrated edge during a tearing operation, said member being pivotally mounted on said flanges wherein said member comprises a wire loop having opposing arms adapted to press against said paper when pivoted, a lower parallel leg with serrations and intermediable stub shafts extending laterally outward into said flanges including a pair of side ends connecting said arms with said lower serrated leg.

2. A dispenser as in claim 1 wherein said side ends are each inclined at an acute angle towards said stub shafts.

3. A dispenser as in claim 2 wherein said arms and stub shafts are formed by a stiff wire looped over from each said arm end outwardly towards said flanges to form said stub shaft providing a one piece member.

* * * * *